US007719421B2

(12) United States Patent
Zovic et al.

(10) Patent No.: US 7,719,421 B2
(45) Date of Patent: May 18, 2010

(54) SECURITY DEVICE AND SYSTEM THEREFOR

(75) Inventors: David Zovic, 4 Lightwood Place, Brampton, Ontario (CA) L6S 5W1; Peter Padula, Mississauga (CA)

(73) Assignees: 2049178 Ontario, Inc., Mississauga, Ontario (CA); David Zovic, Brampton, Ontario (CA)

( * ) Notice: Subject to any disclaimer, the term of this patent is extended or adjusted under 35 U.S.C. 154(b) by 342 days.

(21) Appl. No.: 11/345,385

(22) Filed: Feb. 2, 2006

(65) Prior Publication Data

US 2006/0187064 A1 Aug. 24, 2006

Related U.S. Application Data

(60) Provisional application No. 60/649,548, filed on Feb. 4, 2005.

(51) Int. Cl.
*G08B 13/14* (2006.01)

(52) U.S. Cl. ..... 340/571; 292/62; 70/63

(58) Field of Classification Search ... 340/571.1–572.9, 340/426.1, 426.35, 426.36, 571; 70/63, 15, 70/18, 69; 292/62
See application file for complete search history.

(56) References Cited

U.S. PATENT DOCUMENTS

| | | | | |
|---|---|---|---|---|
| 5,230,541 | A * | 7/1993 | Nowak | 292/288 |
| 6,196,033 | B1 * | 3/2001 | Dowdle | 70/16 |
| 6,694,655 | B2 * | 2/2004 | Redburn et al. | 40/664 |
| 2002/0129628 | A1 * | 9/2002 | Skalberg | 70/18 |
| 2005/0001041 | A1 * | 1/2005 | McCarthy et al. | 235/492 |
| 2005/0193783 | A1 * | 9/2005 | Zovic et al. | 70/69 |
| 2006/0220857 | A1 * | 10/2006 | August et al. | 340/572.1 |

* cited by examiner

*Primary Examiner*—Davetta W Goins
*Assistant Examiner*—Edny Labbees
(74) *Attorney, Agent, or Firm*—Young Basile Hanlon & MacFarlane, P.C.

(57) ABSTRACT

A security system and security device for securing a piece of luggage having a locking means, the security system and security device having a housing with two or more passageways and defined therethrough and a pawl, wherein said a pawl projects into said two or more passageways, and a security strap that is adapted to be inserted into the locking means and the two or more passageways, wherein the security strap is adapted to engage with the pawl to securely link the housing to the piece of luggage.

1 Claim, 9 Drawing Sheets

SECURITY DEVICE AND SYSTEM THEREFOR

FIELD OF THE INVENTION

The present invention relates to the field of security, and more particularly to a security device for securing luggage.

BACKGROUND OF THE INVENTION

The security of airports and other transportation facilities has become a significant area of concern in recent years. The handling and management of passenger luggage has often been at the root of these concerns. Presently, passengers intending to board an aircraft must deposit luggage and other baggage with airline staff at a check-in facility. Each piece of luggage is tagged at the check-in facility with a sticker, hang-tag or the like that corresponds to the destination of the passenger. The tagged luggage is then transferred through the airport to the hold of the aircraft.

In the course of transferring the luggage to aircraft, the contents of the luggage may be inspected by security personnel. Inspection usually involves, at a minimum, some form of electronic inspection, such as x-ray imaging. Sensors for detecting trace elements of explosives and/or drugs may also be employed. If the electronic inspection uncovers the possible presence of unauthorized contraband, the piece of luggage will be opened and subjected to a visual contents inspection. During the course of transferring the luggage, the unsecured nature of the piece of luggage permits its contents to be altered, inter alia, by baggage handlers or other airport employees. The contents of unsecured luggage are vulnerable to theft, as well as the possible introduction of explosives, drugs or other contraband into the luggage.

In order to inhibit such theft and tampering, many passengers utilize locks to secure the contents of their luggage. As a result of the possible need for visual contents inspection, the passenger assumes the risk of the lock being forced open and damaged by security personnel. Following such visual inspection, the damaged lock cannot be resecured to the luggage and, thus, the contents of the luggage are vulnerable to theft and/or tampering. Conversely, other forms of locking devices may be repeatedly opened by security personnel without the knowledge of the owner of the piece of luggage.

In order to inhibit such theft and tampering, many passengers utilize locks to secure the contents of their luggage. As a result of the possible need for visual contents inspection, the passenger assumes the risk of the lock being forced open and damaged by security personnel. Following such visual inspection, the damaged lock cannot be resecured to the luggage and, thus, the contents of the luggage are vulnerable to theft and/or tampering. Conversely, other forms of locking devices may be repeatedly opened by security personnel without the knowledge of the owner of the piece of luggage.

SUMMARY OF THE INVENTION

In a first aspect, the invention is directed to a security device (22) for securing a piece of luggage having a locking means, the security device (22) having a housing (26) with two or more passageways (34) and (36) defined therethrough and a pawl (48), wherein the a pawl (48) projects into the two or more passageways (34) and (36), and a security strap (24) that is adapted to be inserted into the locking means and the two or more passageways (34) and (36), wherein the security strap (24) is adapted to engage with the pawl (48) to securely link the housing (26) to the piece of luggage.

The invention further seeks to provide a security device (22) having a housing which includes a radio frequency transponder (54) for locating the position of the piece of luggage. The invention may further provide a security device (22) having a security strap (24) that is integrally formed within the housing (26).

The invention may further provide a security strap (24) having a serrated, elongated body (38) having a tail end (44) and a girth that is sufficiently small to enable the security strap (22) to be inserted and advanced along the two or more passageways (34) and (36).

The invention further seeks to provide a security device (22) having two or more passageways (34) and (36), wherein the two or more passageways (34) and (36) including a first passageway (34) and a second passageway (36), and wherein the security strap (24) is inserted into the first passageway (34) and engaged by the pawl (48) to secure the piece of luggage. The security strap (24) may be bisected and removed from the first passageway (34), and wherein a new security strap (124) may be inserted into the second passageway (36), the locking means and the first passageway (34) to resecure said piece of luggage.

The invention further seeks to provide a security device (22) with a new security strap (124) having an elongated head (56), serrated, elongated body (138) having a tail end (144) and a girth that is sufficiently small to enable the new security strap (124) to be inserted and advanced along the two or more passageways (34) and (36).

In a second aspect, the invention is directed to a security system (20) for securing a piece of luggage having a locking means, the security system (20) including a housing (26) having two or more passageways (34) and (36) defined therethrough and a pawl (48), wherein the pawl (48) projects into the two or more passageways (34) and (36), and a security strap (24) adapted to be inserted into the locking means and the two or more passageways (34) and (36), wherein the security strap (24) is adapted to engage with the pawl (48) to securely link the housing (26) to the piece of luggage.

The invention further seeks to provide a security system (20) wherein the housing (26) includes a radio frequency transponder (54) for locating the position of said piece of luggage. The security system (20) may include two or more passageways (34) and (36) including a first passageway (34) and a second passageway (36), and wherein the security strap (24) is inserted into the first passageway (34) and engaged by the pawl (48) to secure the piece of luggage.

The invention also seeks to provide a security system (20) wherein the security strap (24) may be bisected and removed from the first passageway (34), and wherein a new security strap (124) may be inserted into the second passageway (36), the locking means and the first passageway (34) to resecure the piece of luggage.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF THE INVENTION

Reference is made to FIGS. 1-14 which illustrate a security system 20 made in accordance with a preferred embodiment of the present invention. The security system 20 comprises a security device 22 and a disposable security strap 24, which are hereinafter described in detail with reference to the Figures.

Figure 1:
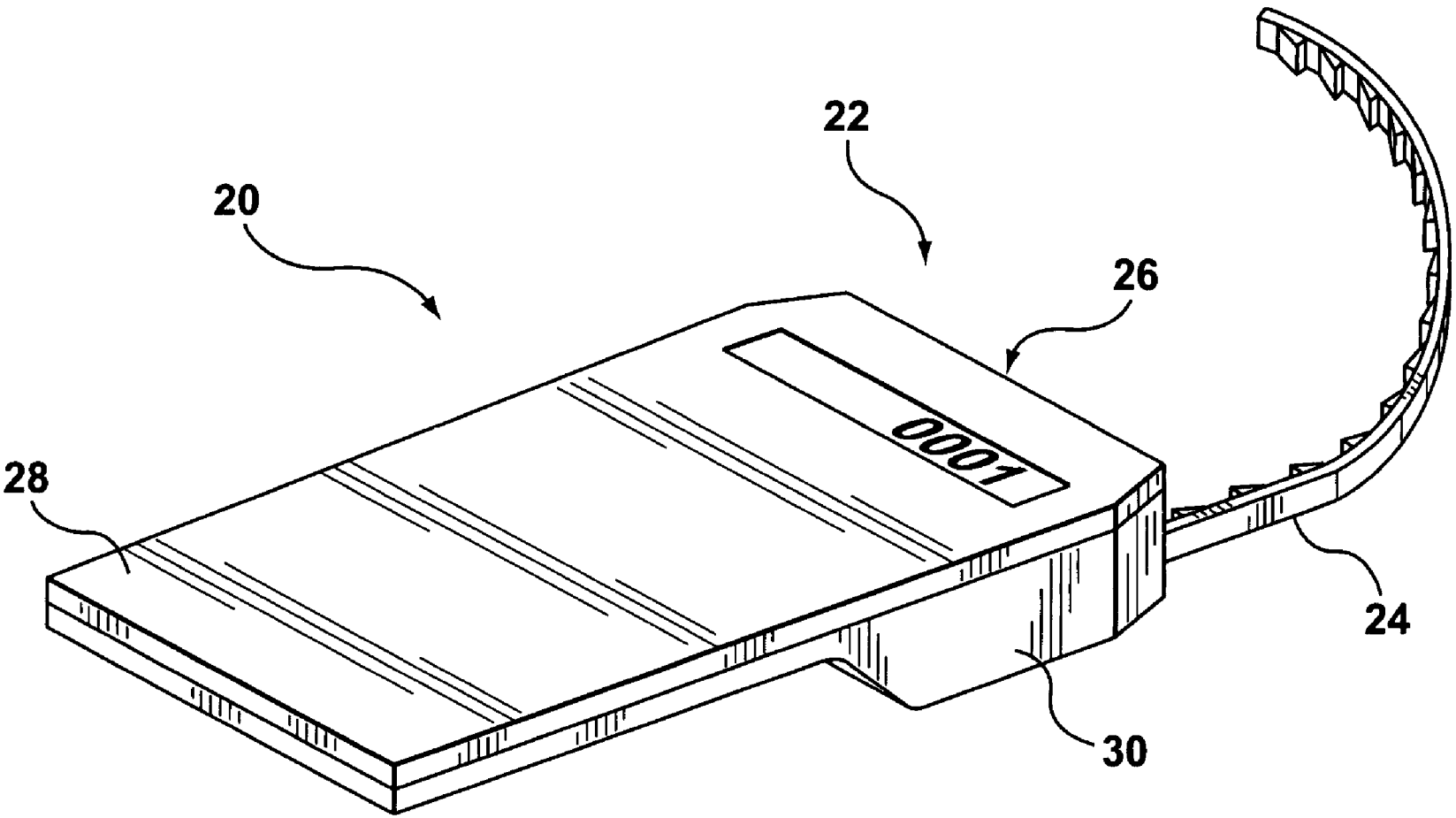
FIG. 1 is a perspective view of a security system according to a preferred embodiment of the present invention, the security system including a security device and a strap.
Figure 2:
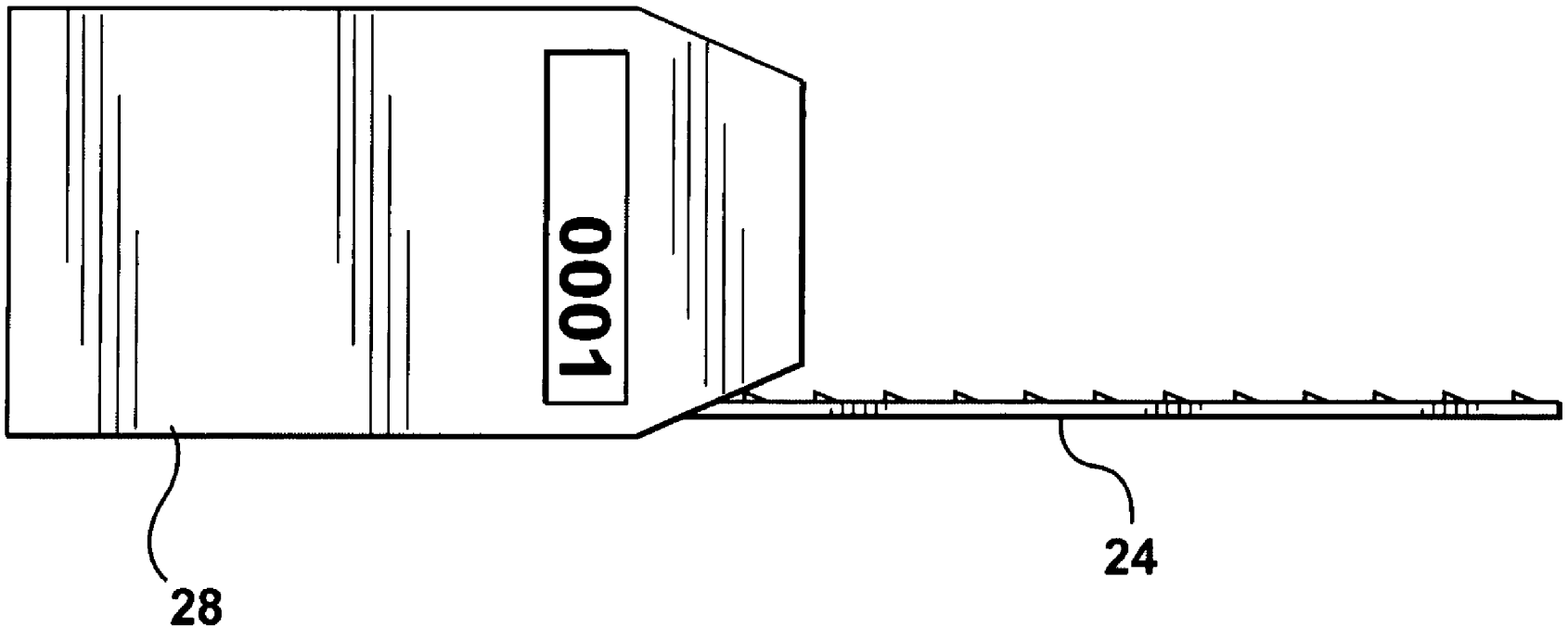
FIG. 2 is a top plan view of the security device and strap of FIG. 1.
Figure 3:
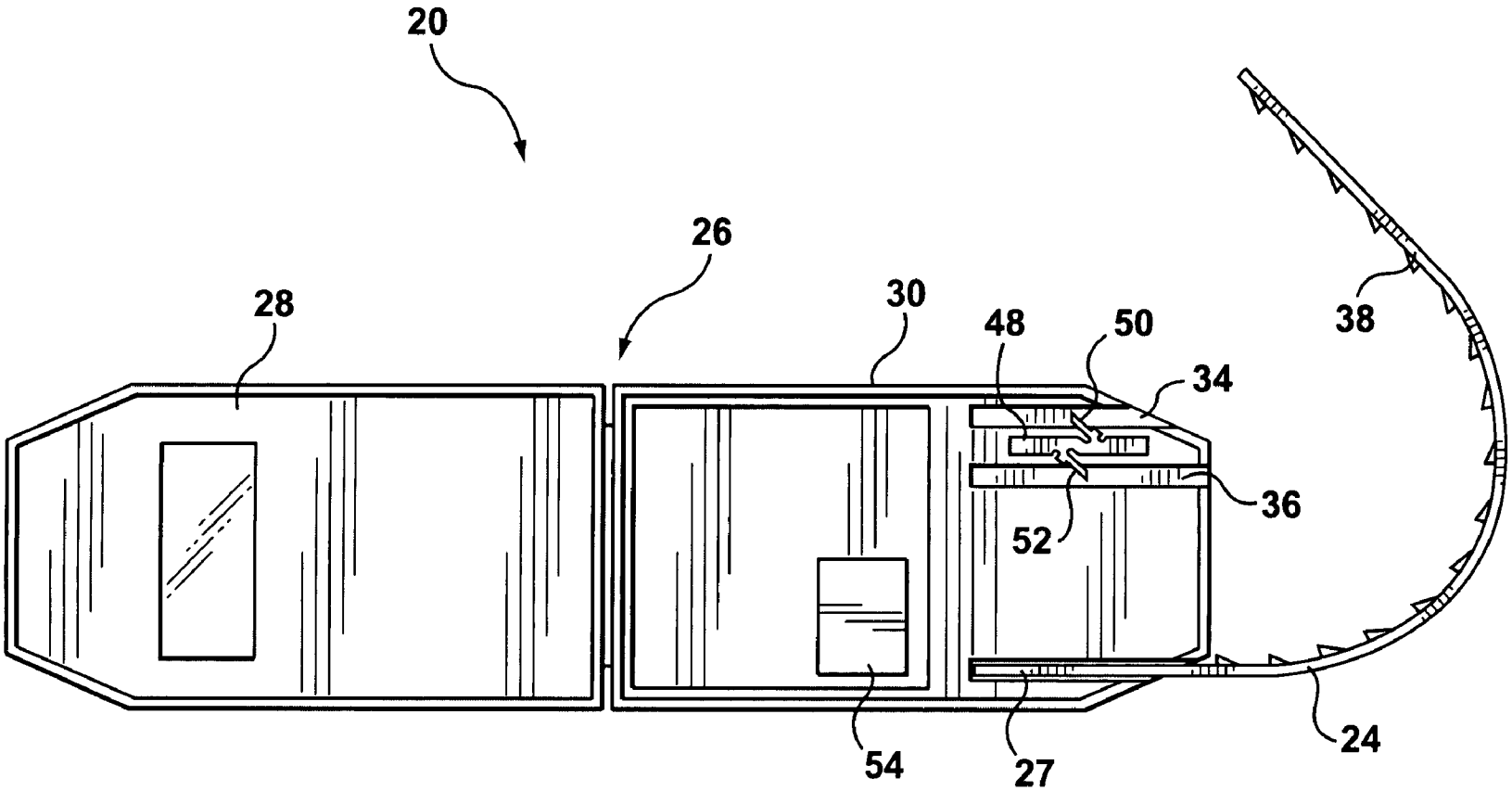
FIG. 3 is a view of the interior of the security device and strap of FIG. 1.
Figure 6:
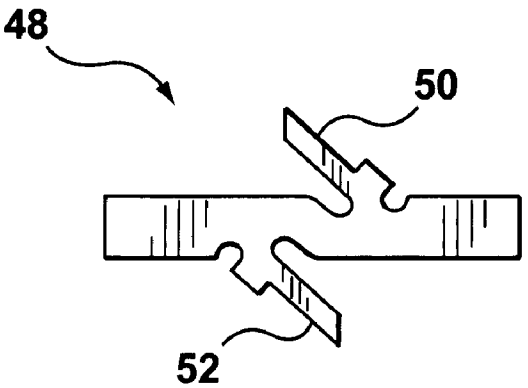
FIG. 6 is a top plan view of the pawl of FIG. 3.
Figure 4:
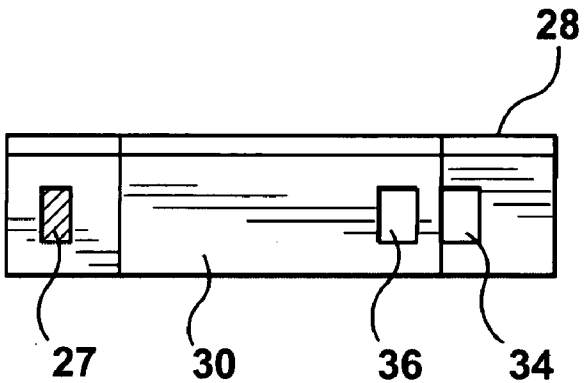
FIG. 4 is an end view of the security device and strap of FIG. 1 showing the first and second passageways and the base portion of the strap.

Referring to FIGS. 1-4, security device 22 includes a housing 26 formed of a cooperating housing cover 28 and a housing body 30. The housing cover 28 and the housing body 30 are each formed of a suitable plastic material, and are sonically welded to one another in use. The housing 26 has two or more passageways defined therethrough. The housing 26 shown in FIGS. 3 and 4 is formed with a first passage way 34 and a second passageway 36 extending therethrough. It should be understood that the housing 26 may be formed with more than two passageways adapted to receive one or more security straps 24 therein. The housing 26 may also include a viewing window to view the one or more security strap 24. Moreover, the housing 26 may be provided with a X-ray label (not shown) which indicates whether the luggage to which to security device 22 is secured has been examined using an X-ray device. The x-ray label may be adapted to change colour or display the words "X-RAY" following the examination of the luggage using the X-ray device, for example.

Figure 5:
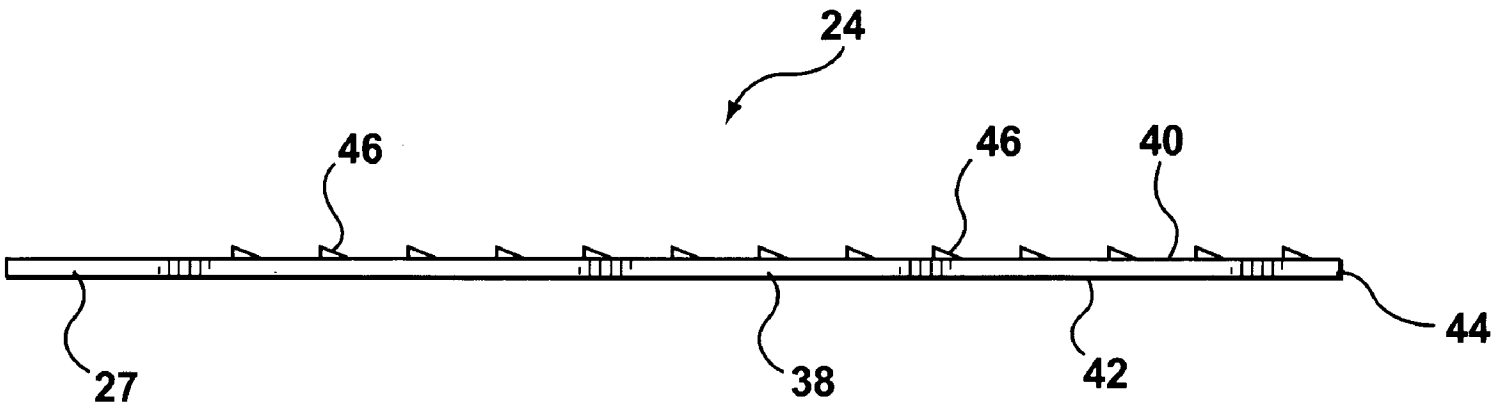
FIG. 5 is a side elevation view of the strap of FIG. 1.

Referring to FIGS. 3, 4 and 5, a base portion 27 of security strap 24 may be inserted into the housing 26 before the housing body 30 and cover 28 are sonically welded to one another. Alternatively, the base portion 27 of security strap 24 may be integrally formed or provided within the housing 26. In a preferred embodiment the security strap 24 is made of a plastic material. The security strap 24 includes a generally elongate body 38 having a girth that is sufficiently smaller in dimension than the passageways 34 and 36 to permit the security strap 24 to be inserted and advanced along the passageways 34 and 36. Body 38 includes an operative surface 40 and a backing surface 42 that extend generally along the length of the body 38 to a tail end 44. Operative surface 40 is provided with a plurality of inclined ribs or serrations 46.

Security device 22 is shown in FIGS. 3, 4, 5 and 6 with the housing cover 28 removed for clarity and to show a pawl 48 mounted on the interior of housing 26. Pawl 48 includes a first engagement surface 50 and a second engagement surface 52 that project into the first passageway 34 and the second passageway 36, respectively. The first and second engagement surfaces 50 and 52, respectively, are inclined substantially the same as the inclination of the ribs 46 of the operative surface 44 of the strap 24. The first engagement surface 50 and the second engagement surface 52 are oppositely inclined. It should be understood that the ribs 46, first engagement surface 50 and second engagement surface 52 may have any suitable shape, configuration or inclination to enable the engagement of the security strap 14 with the pawl 48 as is known by a person skilled in the art.

Figure 7:
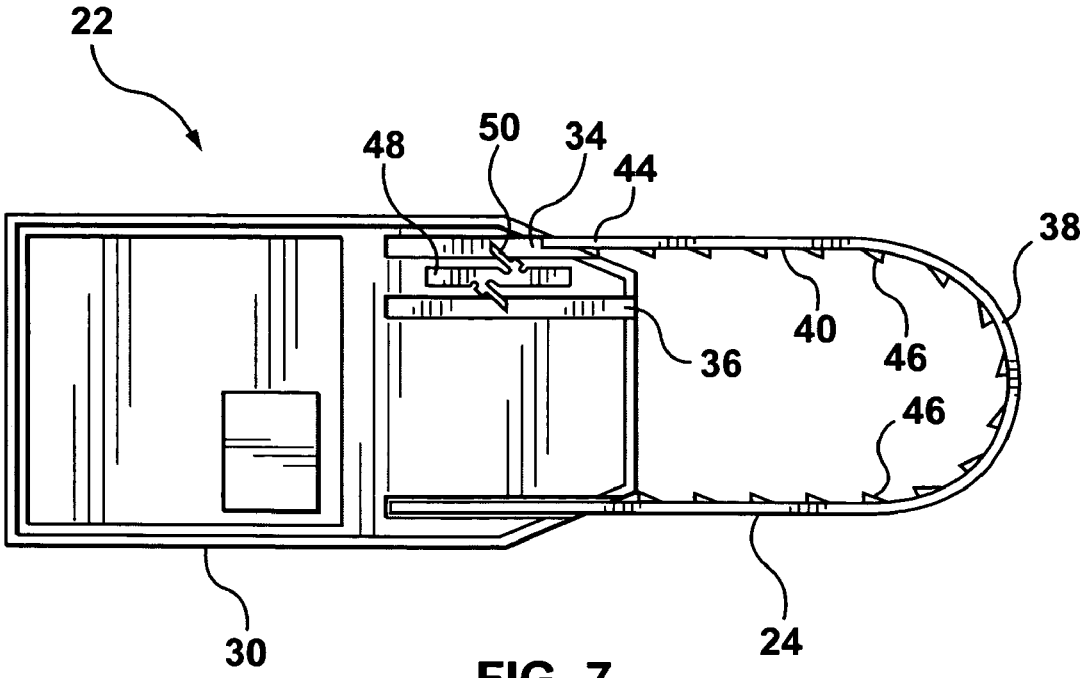
FIG. 7 is a view of the security device of FIG. 3 with the security strap inserted or threaded into the first passageway.
Figure 8:
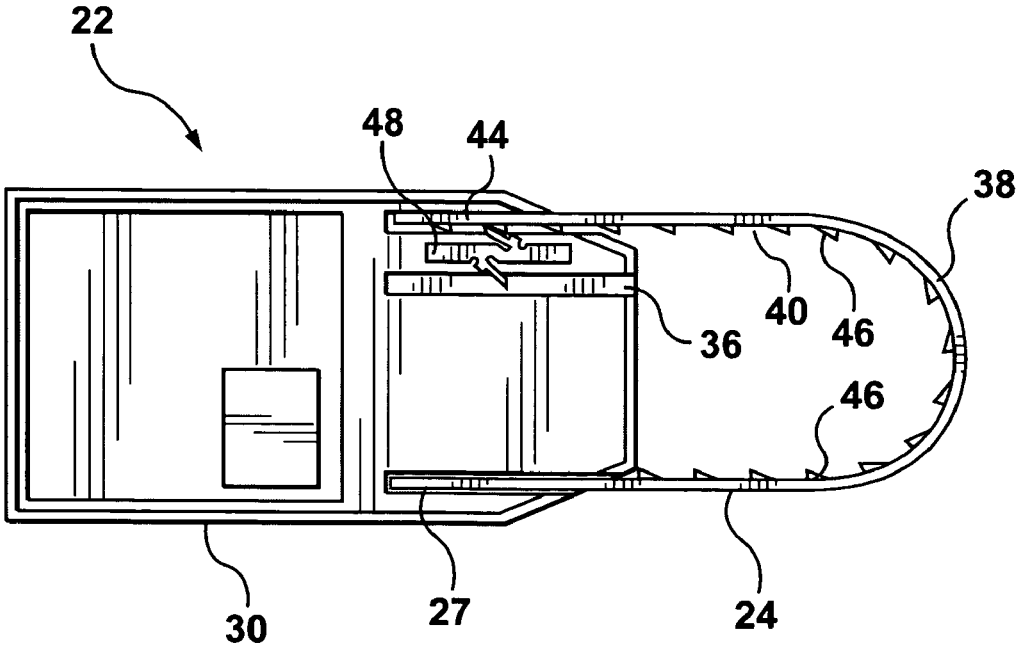
FIG. 8 is a view of the security device of FIG. 7 with the security strap advanced further through the first passageway.

As shown in FIGS. 3, 7 and 8, housing 26 is adapted to contain a tag or transponder 54 for locating the position of the piece of luggage within airports, as well as in the hold of the aircraft. Housing 26 of the security device 22 is preferably formed from a material that permits the transmission or communication of radio frequencies from the transponder 54 to a reader device. A suitable material for the housing 26 includes, for example, plastic. The terms "tag" and "transponder" are interchangeable radio frequency identification terms that refer to an electronic circuit comprised of a transceiver (e.g. transmitter/receiver), supporting circuitry and memory device. The transponder 54 may comprise of a chip, antennae, an internal power source or a combination thereof mounted within the housing 26 of the security device 22. The chip may consist of a processor, a memory device and a radio transmitter to enable the transponder 54 to communicate via radio frequency to a reader device (not shown).

It should be understood that the transponder 54 may be any suitable active or passive radio frequency identification technology known by persons skilled in the art. For example, an active radio frequency identification transponder may be a self-powered device which enables the transponder to have greater communication distance and a larger memory device capacity. Alternatively, a passive radio frequency identification transponder may not consist of an internal power source, but rather may be powered by an electromagnetic signal that is transmitted or communicated from the reader device. The signal received by the transponder 54 from the reader device may then charge an internal capacitor (not shown) in the transponder 54, which in turn will then supply the power required to communicate with the reader device.

It should be further understood that the transponder 54 may be a Read Only (R/O), Read Write (R/W), or Write Once Read Many (WORM) device. Read Only devices are transponders which are pre-programmed with an electronic indicia, such as a serial number or bar code. Read Write transponders may be used for security applications that require the electronic indicia to be stored in the transponder and updated dynamically. A Write Once Read Many transponder allows for the electronic indicia to be stored within the transponder once. The identification data stored to the transponder cannot be changed, but may be read a plurality of times by, for example, the reader device.

Moreover, the transponder 54 may be adapted to utilize any suitable radio frequency range, including, but not limited to low radio frequencies between 125 and 134.2 kHz, high radio frequencies between 8 MHz and 16 MHz, or ultra high radio frequencies between 300 MHz to 3 GHz in the radio spectrum. It is understood, however, that any other suitable form of communication may be used in association with the transponder 54 and the reader device, such as sonic, ultrasonic, infrared, electronic, or electromagnetic, for example.

Referring to FIGS. 7 and 8, a device 22 is shown with housing cover 28 removed for clarity and to show the use of the device 22. In use, body 38 of the strap 24 may be passed through a locking means on a piece of luggage, such as a hasp, zipper, handle or cooperating parts adapted to receive the shackle of a padlock or like device, for example. The strap 24 is then threaded tail end 44 first into first passageway 34. The strap 24 is typically secured by the check-in personnel. The smaller dimension of the elongate body 38 of the security strap 24 relative to the first and second passageway 34 and 36 renders this a relatively simple process.

As the security strap 24 advances through the first passageway 34, the first engagement surface 50 of the pawl 48 falls into the interdental spaces between the ribs 46 on the operative surface 40 of the strap 24 so as to arrest motion of the body 38 through the second passageway 36 otherwise than tail end 44 first. The housing 26 and the pawl 48 thus form a linking means for receiving said strap 24 and, when in receipt of said strap 24, for securely linking longitudinally spaced-apart portions thereof.

Figure 9:
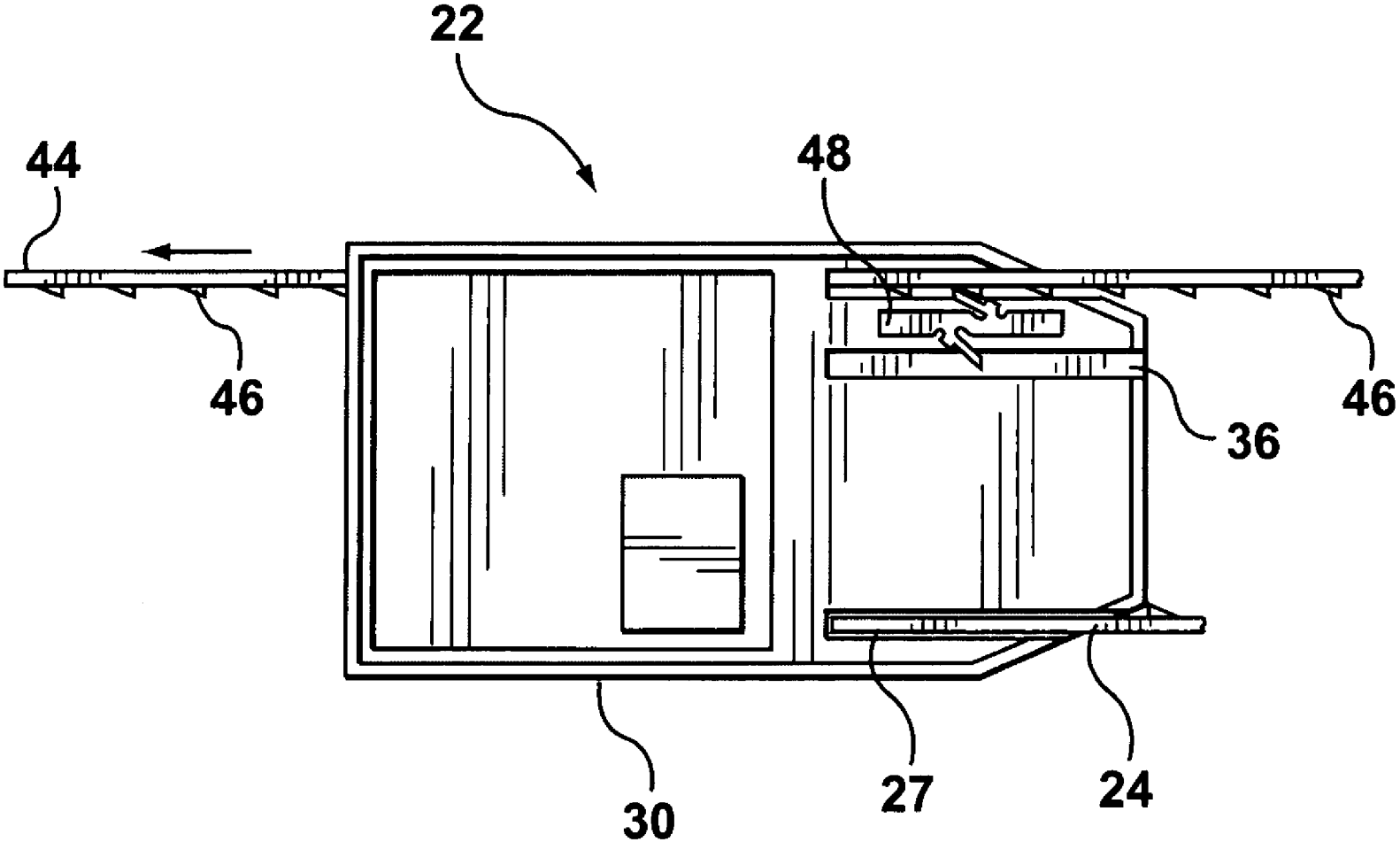
FIG. 9 is a view of the security device of FIG. 8 with the security strap cut.
Figure 10:
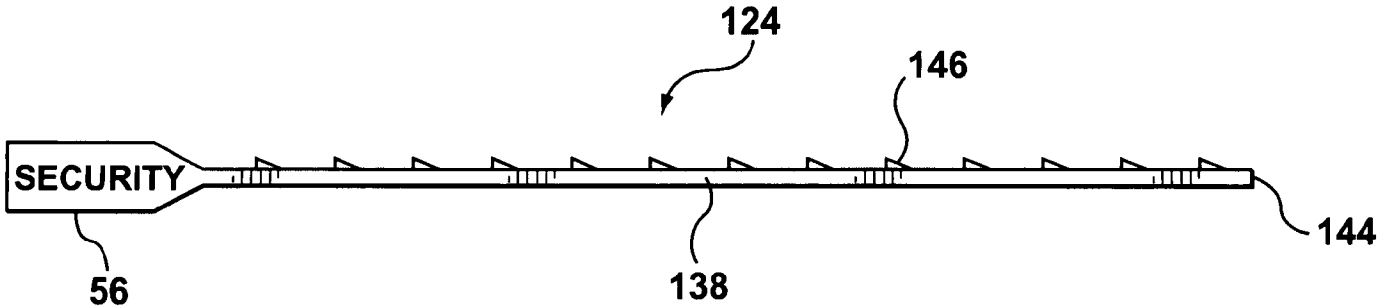
FIG. 10 is side elevation view of a new security strap in an embodiment of the present invention.
Figure 11:
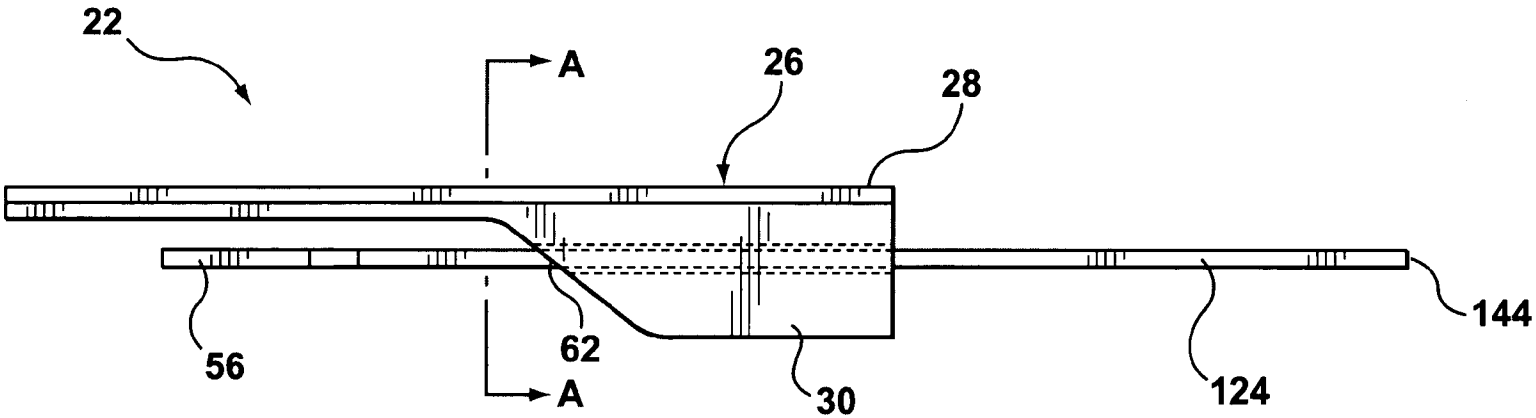
FIG. 11 is a side elevation view of the security device of FIG. 1 with the new security strap shown in FIG. 10 inserted or threaded into the second passageway.
Figure 12:
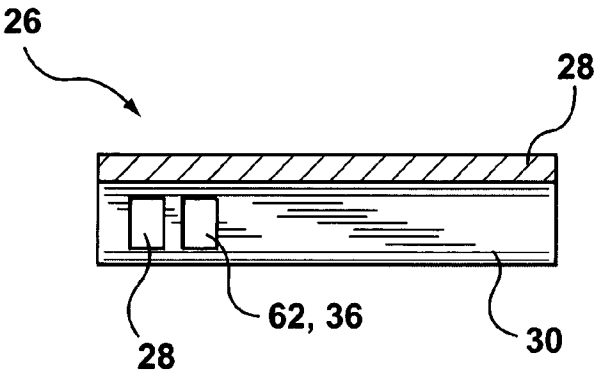
FIG. 12 is a sectional view of the security device of FIG. 11 along the section A-A showing the first and second passageways and the inlet.

After the security strap 24 has been passed through the first passageway 34, as shown in FIG. 8, the contents of the luggage are secured. To remove or detach the security device 22 from the luggage, the passenger or security personnel must bisect or cut the strap 24. With the strap 24 cut, the tail end 44 may be removed from the first passageway 34, as shown in FIG. 9. The base portion 27 and at least a portion of the strap 24 will remain attached to the housing 30 since it is integrally formed or sonically welded within the security device 22. By this design, the base portion 27 of the strap 24 extends from the housing 26 and acts as an indicator to the passenger that their luggage has been opened.

Following the visual inspection of the contents of the piece of luggage by the security personnel, the security device 22 may be resecured to the piece of luggage using a new strap 124. As shown in FIGS. 10, 11, 12 and 13, the new strap 124 includes an enlarged head 56 and an elongate body 138 having a tail end 144. The head 56 is greater in dimension than the first passageway 34. Strap body 38 and new body 138 are identical, except that the new strap is provided with the enlarged head 56. Additionally, the new body 138 may be provided with a label or different colour to identifying the person who opened the luggage (i.e. check-in staff, security personnel and/or custom agents).

To resecure the security device 22, the body 138 of the new strap 124 is threaded tail end 144 first into an inlet 62 and through second passageway 36. As the new security strap 124 advances through the second passageway 36, the second engagement surface 52 of the pawl 48 falls into the interdental spaces between a plurality of ribs 146 on an operative surface 140 of the new strap 124 so as to arrest motion of the body 142 through the second passageway 36 otherwise then tail end 144 first. At the same time, the enlarged head 56 of the strap 124 precludes passage of the head 56 through the inlet 62 of the second passageway 36.

Figure 14:
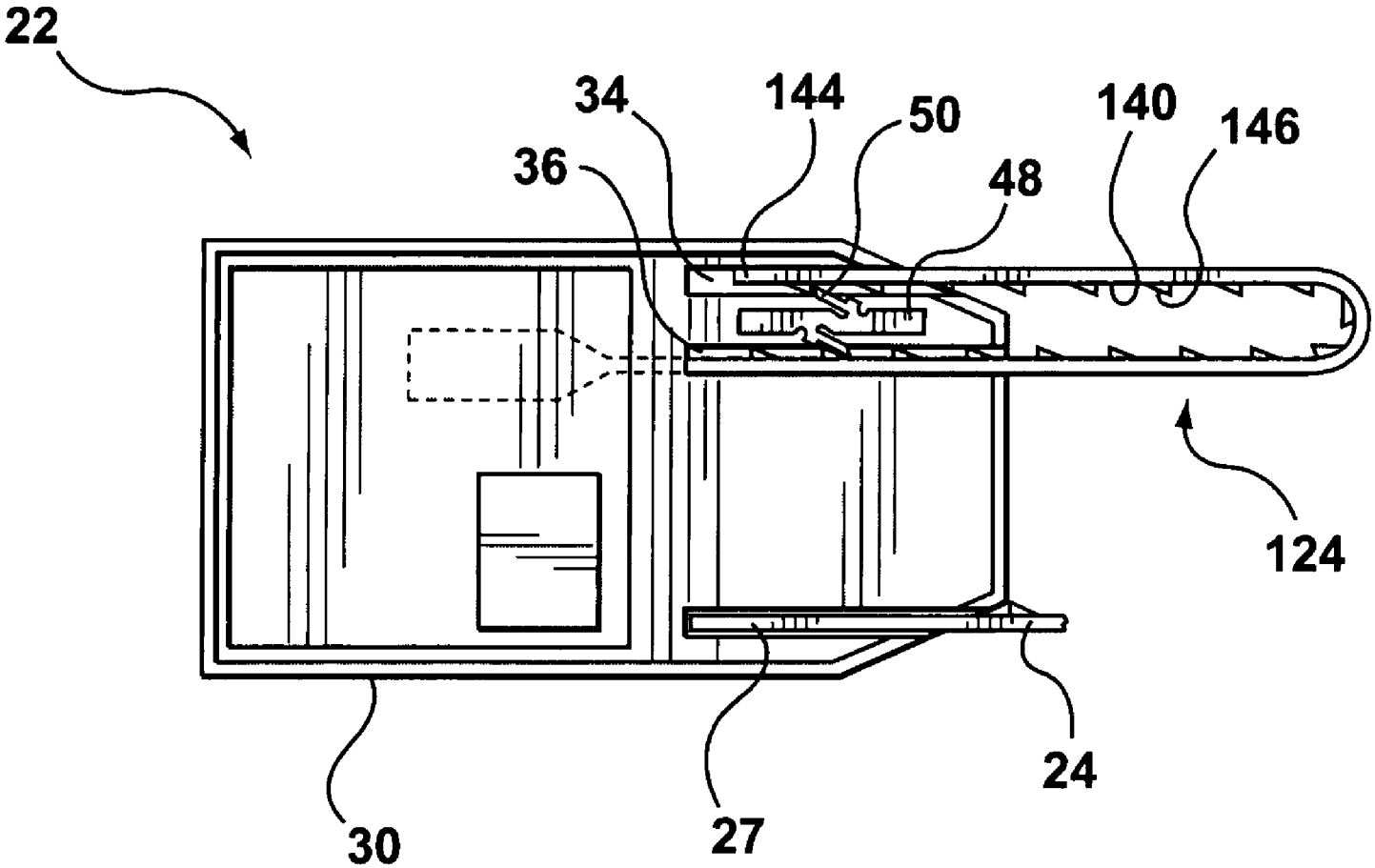
FIG. 14 is a view of the security device of FIG. 3 with the new security strap shown in FIG. 10 inserted or threaded into the first passageway.

The strap 124 is then passed through a hasp, zipper or handle, for example, on the piece of luggage (not shown). Tail end 144 is then threaded into the first passageway 34, as shown in FIG. 14. The smaller dimension of the elongate body 138 of the security strap 124 relative to the first and second passageway 34 and 36 renders this a relatively simple process.

As the security strap 124 advances through the first passageway 34, the first engagement surface 50 of the pawl 48 falls into the interdental spaces between the ribs 146 on the operative surface 140 of the strap 124 so as to arrest motion of the body 138 through the first passageway 34 otherwise than tail end 144 first. The housing body 30 and the pawl 48 thus form a linking means for receiving said strap 124 and, when in receipt of said strap 124, for securely linking longitudinally spaced-apart portions thereof.

After the security strap 124 has been passed through the second and first passageways 34 and 36, as shown in FIG. 14, the contents of the luggage are resecured. To remove or detach the security device 22 from the luggage, the passenger or security personnel must bisect or cut the strap 124. With the strap 124 cut, the tail end 144 may be removed from the first passageway 34 since its retraction therefrom is no longer impeded by the enlarged head 56. The removal of the enlarged head 56 end of strap 124 from the second passageway is impeded by the enlarged head 56 and the second engagement surface 36 of the pawl 48. By this design, the enlarged head 56 end of the strap 124 remains in the second passageway 36 and acts as an indicator to the passenger that their luggage has been opened on a second occasion.

The security device 22 described herein is provided with the first and second passageways 34 and 36. It is understood that the security device 22 may have more than two passageways to enable the security device 22 to be opened and resecured several times during the course of transferring the piece of luggage to and from the aircraft.

The security system 20 can be used with any conventional piece of luggage that is of the type that has cooperating parts adapted to receive the shackle of a padlock or the like to permit the piece of luggage to be locked closed. For example, the security system can be used with a piece of luggage having a hasp; a piece of luggage having a zipper with dual pulls that can be locked together; or a piece of luggage that has a zipper with a single pull with a terminally positioned lug, in which case the zipper pull and the lug can be locked together. With the security strap 24 operably received by the cooperating parts of such a piece of luggage (not shown), and said strap operably received by the linking means, the piece of luggage cannot be opened.

In a preferred embodiment of the system, a controlled supply of security packages (not shown) are provided to check-in personnel at an airport. Each package consists of a security device 22 and a security strap 24 as hereinbefore described. The transponder 54 of the security device is provided with a unique permanent electronic indicia associated with the device, such as an encrypted code or serial number. The housing of the security device may also be provided with a permanent visual indicia that corresponds to the electronic indicia of the transponder. The package may also include a self-adhesive label bearing the permanent visual indicia for attachment to the boarding pass of the passenger.

One such package is provided for each piece of luggage checked by a passenger, and the check-in staff provides for the operable receipt of the security strap by the cooperating parts of the luggage and the linking means of the security device, whereby the piece of luggage cannot be opened. The label is affixed to the boarding pass of the passenger.

A controlled supply of security straps 24 and 124 are provided to authorized persons, namely airport security personnel and customs agents. The security straps 24 and 124 provided to security personnel and customs agents may be coloured differently, or may bear the names "Security" and "Customs", respectively. This will enable a passenger, for example, to determine whether their luggage has been opened after the check-in and, if so, by whom.

Figure 13:
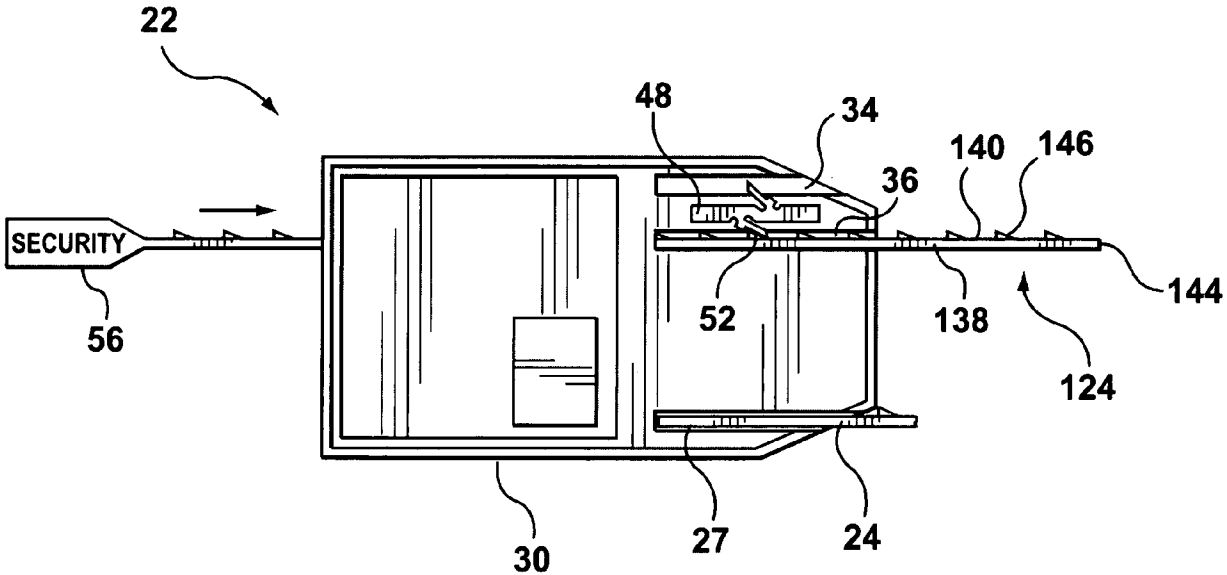
FIG. 13 is a view of the security device of FIG. 3 with the new security strap shown in FIG. 10 inserted or threaded further through the second passageway.

In the event that security personnel or customs agents wish to visually inspect the contents of the piece of luggage, they can bisect or cut the security strap 24 and remove portions thereof from the security device 22, as indicated by the sequence of FIGS. 9 and 13, to permit access to the contents of the piece of luggage. After inspection has been completed, such persons can insert a new security strap 124 into the second passageway 36 and then into the first passageway 34 to secure to the luggage.

In situations where passengers are required to attend to claim their baggage (in contrast to self-serve luggage claim systems), the security system will be inspected by the airline personnel when the luggage to which it is affixed is to be transferred to the passenger. It will be evident that the boarding pass serves as a convenient luggage claim receipt to match a piece of luggage with its owner, since the indicia on the label on the boarding pass should match the indicia on the security device. Also, the transponder 54 may also provide an electronic means for matching the piece of luggage to the passenger. If the indicia on the security device, the strap and the label match are the same as was applied at the check-in, the passenger and airline have good reason to believe that the bag has not been opened. If the indicia on the security strap does not match that of the security strap and label, the passenger and airline have good reason to believe that the bag has been opened by authorized persons.

While a security strap 24 herein is serrated or ribbed, it is understood that other configurations of the strap 24 are possible, provided that suitable modification is made to the pawl 48 or such other gripping mechanism as may be employed to provide the contemplated linking functionality. For example, the security strap 24 could be provided with longitudinally spaced apertures, into which the pawl 48 can engage upon the advancement of the security strap 24 through one or more of the passageways.

While use of the security system 20 is described in the context of a process wherein the baggage is inspected by airline personnel prior to return to the passenger, it will be evident that the tamper evidence functionality of the security system 20 does not require such involvement of airline personnel. Further, it will be evidence that the security device 20 provides a convenient mechanism to permit the passenger to identify his or her piece of luggage in a self-serve luggage claim system, by matching the number affixed to the boarding pass with the number on the security device 22.

Moreover, whereas the use described related to airline, it will be readily appreciated that the security system 20 could be employed in other transportation systems wherein passengers are separated from their luggage. A further use of the security system is in hotels. It is commonplace for persons checking out of hotels to leave their luggage with the hotel for a period of time if their departure from the hotel is delayed. In such circumstances, a supply of security systems 20 could be available at the front desk, and given to the persons checking out for affixation to the luggage. This would provide the departing guest with a measure of security that their bags had not been tampered with while in the custody of the hotel. This security would be even greater in circumstances where the luggage itself has no working lock mechanism.

It is hereinbefore specified that only the strap 24 used with the security device 20 is disposable (since it is broken after use, and thus not suitable for reuse). It should be understood that it is preferable that the security device 20 be constructed in a low-cost manner, and used as a disposable product.

The present invention has been described with regard to specific embodiments. However, it will obvious to persons skilled in the art that a number of variants and modifications can be made without departing from the scope and spirit of the invention.

The invention claimed is:

1. A security system comprising:

a security strap having a head and an elongate tail; and a security device comprising:

a housing having two sides opposite one another and further comprising a first passageway and a second passageway defined therethrough and having a first engagement surface which projects into the first passageway and second engagement surface which projects into the second passageway; and an elongate body extending from the housing to an end adapted to be inserted through the first passageway at one side wherein, in use, following operative insertion of the end of the body into the first passageway, the first engagement surface engages the end to prevent retraction of the end from the first passageway;

the body, when prevented from retraction from the first passage way is bisected to permit the severed end of the body to be pulled completely through and drawn from the first passageway at the second side;

the elongate tail is adapted to be inserted through the second passageway at the second side and then through the first passageway at the first side and engaged to prevent retraction, respectively, by the second engagement surface and the first engagement surface;

the strap is prevented from being drawn completely though the second passageway by interference between the head and the housing such that, when the elongate tail is inserted through the second passageway and then through the first passageway, the housing securely links longitudinally spaced-apart portions of the strap.

* * * * *